US006182824B1

(12) United States Patent
Kolton et al.

(10) Patent No.: US 6,182,824 B1
(45) Date of Patent: Feb. 6, 2001

(54) HANGER FOR ARTICLE-CONTAINING ENVELOPES

(75) Inventors: Chester Kolton, Westfield; Michael Norman, East Brunswick, both of NJ (US)

(73) Assignee: B&G Plastics, Inc., Newark, NJ (US)

( * ) Notice: Under 35 U.S.C. 154(b), the term of this patent shall be extended for 0 days.

(21) Appl. No.: 09/205,206

(22) Filed: Dec. 4, 1998

(51) Int. Cl.[7] ..... B65D 85/18; A47G 25/14
(52) U.S. Cl. ..... 206/278; 223/85; 383/23
(58) Field of Search ..... 206/278, 292; 383/23; 248/317; 223/85, 94

(56) References Cited

U.S. PATENT DOCUMENTS

| | | | | |
|---|---|---|---|---|
| 593,346 | * | 11/1897 | Baehn | 206/278 X |
| 2,078,438 | * | 4/1937 | Baxter | 383/23 X |
| 2,215,139 | * | 9/1940 | Uhlmann | 248/317 X |
| 3,376,618 | * | 4/1968 | Schwarzkopf | 383/23 X |
| 3,495,763 | * | 2/1970 | Schmidt et al. | 383/23 X |
| 3,550,838 | * | 12/1970 | Hart | 383/23 X |
| 3,987,958 | * | 10/1976 | Kamins et al. | 383/23 X |
| 4,714,156 | * | 12/1987 | Kolton et al. | 206/278 X |
| 5,556,014 | * | 9/1996 | Kolton et al. | 206/292 X |
| 5,799,843 | * | 9/1998 | Hsu | 383/23 X |
| 6,012,573 | * | 1/2000 | Kurimoto | 206/278 |

FOREIGN PATENT DOCUMENTS

| | | | | |
|---|---|---|---|---|
| 2142623 | * | 3/1973 | (DE) | 383/23 |
| 2260505 | * | 9/1975 | (FR) | 383/23 |
| 9314985 | * | 8/1993 | (WO) | 383/23 |

* cited by examiner

*Primary Examiner*—Sue A. Weaver
(74) *Attorney, Agent, or Firm*—Robin, Blecker & Daley

(57) ABSTRACT

A hanger is comprised of a one-piece body having a central portion including a main body part and a hook part extending upwardly of the main body part, the main body part defining a forwardly extending projection, and first and second arm parts extending outwardly from the main body part and extending to respective first and second free arm part ends with respective first and second openings being formed at the first and second free arm part ends. The main body part supports the first and second arm parts for folding movement for registry of the first and second openings with the projection. In use of the hanger, the projection is inserted through only the envelope rear wall opening. The first arm part is then folded and its opening is forced over the projection to be retentively retained by the projection. The projection is now inserted through the envelope front wall opening. The second arm part is then folded and its opening is forced over the projection to be releasably retained by the projection.

16 Claims, 2 Drawing Sheets

HANGER FOR ARTICLE-CONTAINING ENVELOPES

FIELD OF THE INVENTION

This invention relates generally to hangers for garments and pertains more particularly to hangers for plastic envelopes containing articles, such as garments.

BACKGROUND OF THE INVENTION

U.S. Pat. No. 3,123,331 shows an example of a type of hanger in widespread use in hanging plastic envelopes or bags containing, e.g., folded shirts. The '331 hanger comprises a one-piece plastic body having a hook portion having a lower end portion from which a projection extends forwardly. Upwardly of the lower end portion is a foldable strap defining a detent for the projection. In use, the projection is inserted through a cardboard header, a lower portion of which is secured to the top of the front and rear walls of a plastic envelope containing the folded shirt. The strap is then folded and the projection is secured in the detent.

The garment industry has come to provide such hangers without the header of the '331 patent, i.e., holes are provided directly in the front and rear walls of a plastic envelope and the projection is inserted through both of the front and rear walls and the detent and projection securement is forwardly of the front wall. The securement is a releasable one, such that a purchaser may open the envelope to inspect the contained article, e.g., to gain a sense of its texture.

A serious problem attending the hanger described immediately above is that the hangers tend to separate from the plastic bag during the inspection of the article. When this occurs, and a customer does not reassemble the envelope and hanger, as is customary, the hangerless envelope is left on a counter and the efficacy of the original hung display of the article is lost.

SUMMARY OF THE INVENTION

It is the primary object of the present invention to provide improved hangers of the types above discussed.

In attaining this and other objects, the invention provides a hanger comprised of a one-piece body having a central portion including a main body part and a hook part extending upwardly of the main body part, the main body part defining a forwardly extending projection, and first and second arm parts extending outwardly from the main body part and extending to respective first and second free arm part ends with respective first and second openings being formed at the first and second free arm part ends. The main body part supports the first and second arm parts for folding movement for registry of the first and second openings with the projection.

In use of the hanger, the projection is inserted through only the envelope rear wall opening. The first arm part is then folded and its opening is forced over the projection to be non-releasably retained by the projection. The projection is now inserted through the envelope front wall opening. The second arm part is then folded and its opening is forced over the projection to be releasably retained by the projection. By the term "releasably" is meant that a customer can manually release the second arm part from the projection. By the term "non-releasably" is meant that a cutting or like operation is necessary to release the first arm part from the projection.

A customer, in inspecting an article, need only release the engagement of the second arm part and the projection to gain access to the article. During the inspection, the hanger is retained with the envelope by virtue of the non-releasable engagement of the first arm part and the projection.

More broadly, the invention will be seen to provide a hanger having first and second diverse securements with an openable article-containing envelope, one being releasable and the other being non-releasable. The first and second securements comprise openings at ends of arm parts foldable relative to the hanger and a detent extending outwardly of the hanger.

In another aspect, the invention will be seen to provide, in combination, an openable article container having front and rear walls and a hanger comprised of a one-piece body having a central portion including a main body part and a hook part extending upwardly of the main body part, the main body part defining a forwardly extending projection, and first and second arm parts, the main body part being disposed rearwardly of the container rear wall, the projection extending through the container front and rear wall openings and through the first and second arm part openings, the first arm part being disposed between the container front and rear walls, the second arm part being disposed on a front surface of the container front wall.

The invention will be further understood from consideration of the following description of preferred embodiments thereof and from the drawings where like reference numerals identify like parts throughout.

DETAILED DESCRIPTION OF PREFERRED EMBODIMENTS

Figure 1:
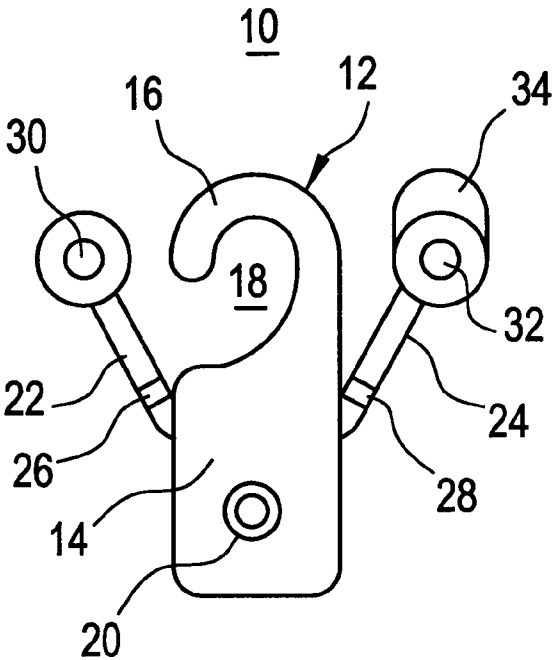
FIG. 1 is a front elevation of a hanger in accordance with the invention.
Figure 2:
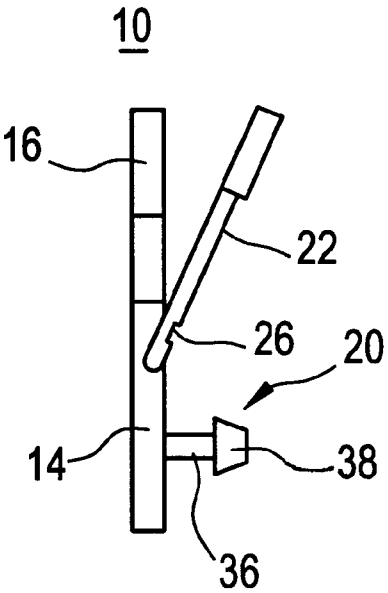
FIG. 2 is a left side elevation of the FIG. 1 hanger.
Figure 3:
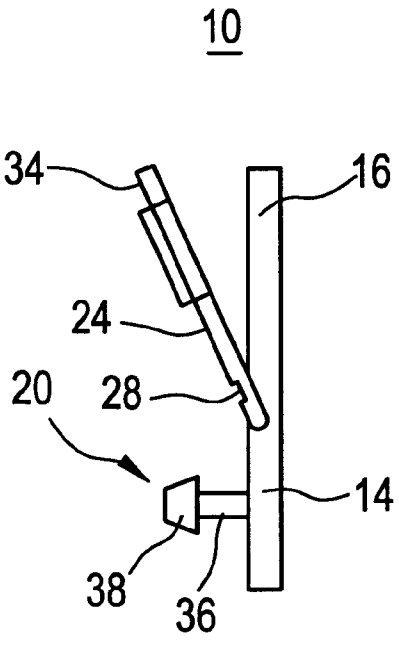
FIG. 3 is a right side elevation of the FIG. 1 hanger.
Figure 5:
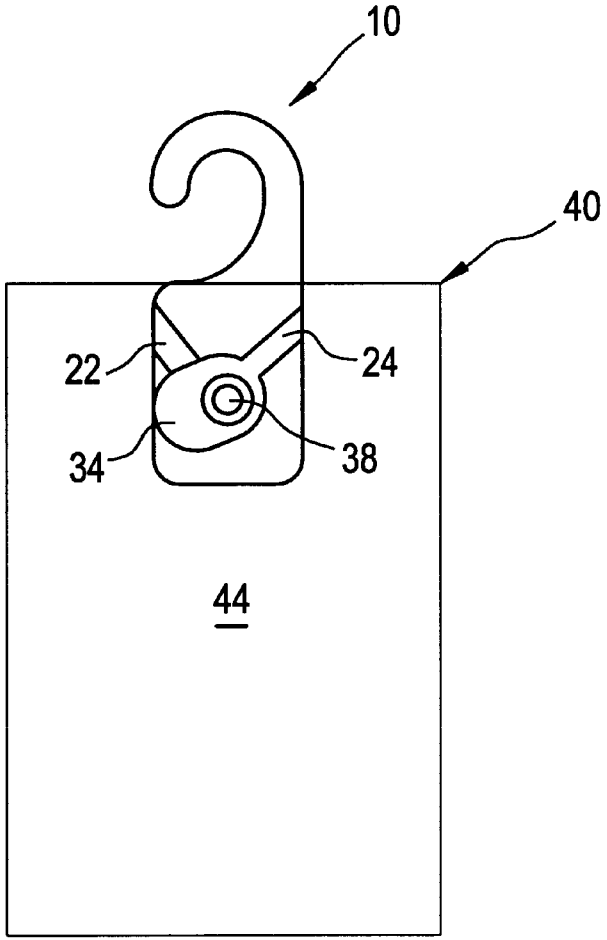
FIG. 5 is a front elevation of the FIG. 1 hanger in a final stage of assembly with an envelope for containment of an article.

Referring to FIGS. 1–3, hanger 10 is comprised of a one-piece body having a central portion 12 including a main body part 14 and a hook part 16 extending upwardly of the main body part and having opening 18 for receipt of a display rod.

Main body part 14 defines a forwardly extending projection 20, and first and second arm parts 22 and 24 extending outwardly from the main body part and extending to respective first and second free arm ends. Thinned sections 26 and 28 of arm parts 22 and 24 define fold lines for the arm parts. First and second openings 30 and 32 are provided at the arm free ends.

Main body part 14 supports first and second arm parts 22 and 24 for folding movement for registry of the first and second openings 30 and 32 with projection 20.
Lip 34 is provided at the free end of arm part 24, outwardly of opening 32. The first and second openings are of respective different diameters for purposes discussed hereinafter.

As is seen in FIGS. 2 and 3, projection 20 includes a shaft part 36 extending forwardly from main body part 14 and a conical detent 38 at a free end of the shaft part.

Conical detent 38 has a given diameter and first opening 30 has a diameter sufficiently less than the given diameter such that, on folding of first arm part 22 and passage of projection 20 through first opening 30, first arm part 22 is non-releasably retained on shaft part 36 interiorly of conical detent 38. Second opening 32 has a diameter sufficiently less than the given diameter such that, on folding of second arm part 24 and passage of projection 20 through second opening 32, second arm part 24 is releasably retained on shaft part 36 interiorly of conical detent 38.

Figure 4:
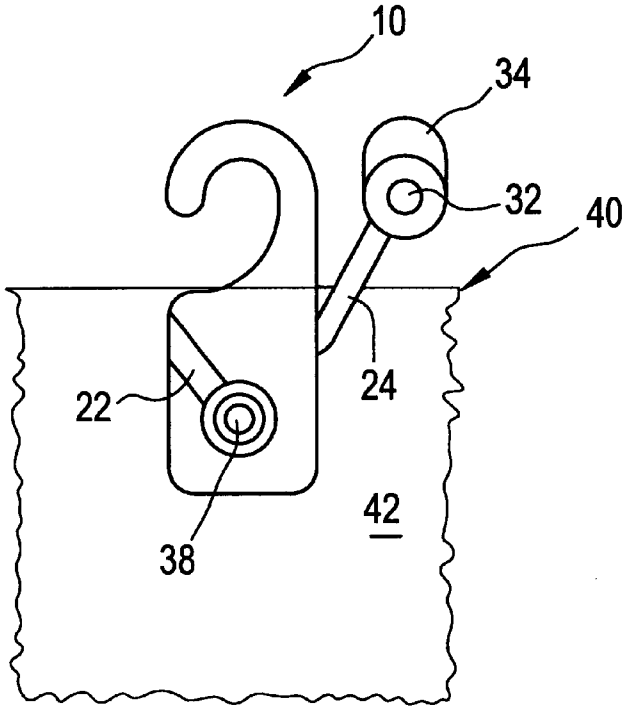
FIG. 4 is a front elevation of the FIG. 1 hanger in a preliminary stage of assembly with an envelope for containment of an article.

In use of hanger, in a preliminary assembly thereof with a garment envelope 40, shown in FIG. 4, projection 20 is inserted through only the envelope rear wall 42 opening. First arm part 22 is then folded and its opening 30 is forced over projection 20 to be retentively engaged by the projection rearwardly of conical detent 38.

In a final assembly step, projection 20 is now inserted through the envelope front wall 44 opening. Second arm part 24 is folded and its opening 32 is forced over projection 20 to be releasably retained rearwardly of conical detent 38.

A customer, in inspecting an article, need only lift lip 34 and apply nominal lifting pressure to release the engagement of second arm part 24 and projection 20 to gain access to the article. During the inspection, the hanger is retained with the envelope by virtue of the non-releasable engagement of first arm part 22 and projection 20.

In addition to the described hanger, the invention will be seen to provide, in combination, an openable article container having front and rear walls and a hanger comprised of a one-piece body having a central portion including a main body part and a hook part extending upwardly of the main body part, the main body part defining a forwardly extending projection, and first and second arm parts, the main body part being disposed rearwardly of the container rear wall, the projection extending through the container front and rear wall openings and through the first and second arm part openings, the first arm part being disposed between the container front and rear walls, the second arm part being disposed on a front surface of the container front wall.

Various changes to the particularly depicted embodiment of the invention may be introduced without departing from the scope of the invention. Accordingly, it is to be appreciated that the particularly disclosed embodiments are intended in an illustrative, and not in a limiting, sense. The true spirit and scope of the invention is set forth in the ensuing claims.

What is claimed is:

1. A hanger comprised of a one-piece body having a central portion including a main body part and a hook part extending upwardly of said main body part, said main body part defining a forwardly extending projection, and first and second arm parts extending outwardly from said main body part and extending to respective first and second free arm ends with respective first and second openings being formed at said first and second free arm part ends, said main body part supporting said first and second arm parts for folding movement for registry of said first and second openings with said projection, said first and second openings being of respective different diameters.

2. The hanger claimed in claim 1, wherein said projection includes a shaft part extending forwardly from said main body part and a conical detent at a free end of said shaft part.

3. The hanger claimed in claim 2, wherein said conical detent has a given diameter and wherein said second opening has a diameter sufficiently less than said given diameter such that, on folding of said second arm part and passage of said projection through said second opening, said second arm part is releasably retained on said shaft part interiorly of said conical detent.

4. The hanger claimed in claim 2, wherein said conical detent has a given diameter and wherein said first opening has a diameter sufficiently less than said given diameter such that, on folding of said first arm part and passage of said projection through said first opening, said first arm part is non-releasably retained on said shaft part interiorly of said conical detent.

5. The hanger claimed in claim 4, wherein said second opening has a diameter sufficiently less than said given diameter such that, on folding of said second arm part and passage of said projection through said second opening, said second arm part is releasably retained on said shaft part interiorly of said conical detent.

6. The hanger claimed in claim 1, wherein said first and second arm parts include reduced thickness portions adjacent said main body part.

7. The hanger claimed in claim 6, wherein said second arm part defines a lifting tab at said free end thereof.

8. The hanger claimed in claim 1, wherein said second arm part defines a lifting tab at said free end thereof.

9. In combination:

(a) an open-mouthed article container having front and rear walls defining respective front and rear wall openings in registry with one another; and (b) a hanger comprised of a one-piece body having a central portion including a main body part and a hook part extending upwardly of said main body part, said main body part defining a forwardly extending projection, and first and second arm parts having respective first and second openings, said main body part being disposed rearwardly of said rear wall, said projection extending through said front and rear wall openings and through said first and second arm part openings, said first arm part being disposed between said front and rear walls, said second arm part being disposed on a front surface of said front wall, said first and second arm part openings being of respective different diameters.

10. The invention claimed in claim 9, wherein said projection includes a shaft part extending forwardly from said main body part and a conical detent at a free end of said shaft part.

11. The invention claimed in claim 10, wherein said conical detent has a given diameter and wherein said second opening has a diameter sufficiently less than said given diameter such that, on folding of said second arm part and passage of said projection through said second opening, said second arm part is releasably retained on said shaft part interiorly of said conical detent.

12. The invention claimed in claim 10, wherein said conical detent has a given diameter and wherein said first opening has a diameter sufficiently less than said given diameter such that, on folding of said first arm part and passage of said projection through said first opening, said first arm part is non-releasably retained on said shaft part interiorly of said conical detent.

13. The invention claimed in claim 12, wherein said second opening has a diameter sufficiently less than said given diameter such that, on folding of said second arm part and passage of said projection through said second opening, said second arm part is releasably retained on said shaft part interiorly of said conical detent.

14. The invention claimed in claim 9, wherein said first and second arm parts include reduced thickness portions adjacent said main body part.

15. The invention claimed in claim 14, wherein said second arm part defines a lifting tab at said free end thereof.

16. The invention claimed in claim 9, wherein said second arm part defines a lifting tab at said free end thereof.

* * * * *